US006869492B1

(12) United States Patent
Kooistra

(10) Patent No.: US 6,869,492 B1
(45) Date of Patent: Mar. 22, 2005

(54) ADJUSTABLE DRYWALL MUD APPLICATOR

(76) Inventor: Russ Kooistra, 6549 Long Lake Road SE., Port Orchard, WA (US) 98367

( * ) Notice: Subject to any disclaimer, the term of this patent is extended or adjusted under 35 U.S.C. 154(b) by 12 days.

(21) Appl. No.: 10/652,522

(22) Filed: Aug. 29, 2003

(51) Int. Cl.[7] ..... E04F 13/02; B05C 1/02; B05C 1/04; B05C 11/04; B05C 17/005; A46B 11/06; B28B 1/29

(52) U.S. Cl. ..... 156/71; 118/205; 118/236; 401/5; 401/48; 401/119; 401/139; 425/87; 425/458

(58) Field of Search ..... 401/5, 48, 118, 401/119, 113, 137, 139; 425/87, 428; 118/205, 207, 263, 303; 156/71, 583.8

(56) References Cited

U.S. PATENT DOCUMENTS

| | | | | |
|---|---|---|---|---|
| 2,420,062 A | | 5/1947 | Ames | 72/128 |
| 3,932,101 A | | 1/1976 | Johnson et al. | 425/458 |
| 4,032,283 A | | 6/1977 | Johnson et al. | 425/458 |
| 4,116,604 A | * | 9/1978 | Johnson et al. | 425/458 |
| 4,451,223 A | | 5/1984 | Mower et al. | 425/458 |
| 5,467,497 A | * | 11/1995 | Greene et al. | 15/235.8 |
| 5,622,729 A | | 4/1997 | Mower | 425/87 |
| 6,155,809 A | | 12/2000 | Edwards et al. | 425/87 |
| 6,450,723 B1 | | 9/2002 | Lithgow | 401/266 |

* cited by examiner

*Primary Examiner*—Chris Fiorilla
*Assistant Examiner*—Sing P. Chan
(74) *Attorney, Agent, or Firm*—Dean A. Craine

(57) ABSTRACT

A drywall mud applicator, designed to quickly and easily apply a first layer of mud or mastic material to a joint in preparation for applying drywall tape thereto. The applicator includes a main housing comprising two side plates pivotally connected to an intermediate member. During use, the side plates are centrally aligned over a joint located between adjacent drywall panels so that each side plate is positioned against the adjoining drywall surface. The intermediate member is longitudinally aligned over the longitudinal axis of the joint. Attached to each side plate is a guide member that slides laterally over the side plate's front surface to control the width of the mud applied to the joint. A guide plate locking mechanism is provided for selectively locking the guide members in a desired position on the two side plates. A bellows is connected to the intermediate member and is used to evenly distribute mud to port openings formed on the two side plates.

20 Claims, 5 Drawing Sheets

ADJUSTABLE DRYWALL MUD APPLICATOR

BACKGROUND OF THE INVENTION

1. Field of the Invention

This invention relates generally to drywall mud applicators and more particularly, to applicators that are adjustable for applying mud to joints located between drywall panels.

2. Description of the Related Art

When drywall is mounted on a wall, a joint is created that is covered by drywall flex and rigid finishing material, including drywall paper tape. The drywall tape is applied over a thin layer of drywall mud applied inside the gap and over the adjoining edges of the drywall panels. Ideally, the layer of drywall mud should be sufficiently wide to completely fill the gap between drywall panels and to cover the areas under the tape to insure bonding of the backside of the drywall tape to the panels. The drywall mud should also be sufficiently thick to bond the tape to the wall.

Drywall panels are installed so that the vertical and horizontal joints are aligned. Because the initial layer of drywall mud must completely fill the gap and be applied in sufficient thickness to the edges on the adjacent panels, it is normally applied by hand, which is very time labor intensive.

What is needed is a drywall mud applicator that can apply an initial layer of drywall mud to a joint and to the adjacent drywall panel surfaces on a straight wall section or on the inside or outside corners.

SUMMARY OF THE INVENTION

It is an object of the present invention to provide a drywall mud applicator for applying a sufficiently thick layer of drywall mud to a joint prior to applying drywall tape.

It is another object of the present invention to provide such an applicator that can be used to apply drywall mud to joints located on a straight wall section or to inside and outside corners.

It is a further object of the invention to provide such an applicator that applies drywall mud continuously and evenly to a long joint.

These and other objects are met by the drywall corner mud applicator, disclosed herein, designed to continuously and easily apply a first layer of mud or mastic material to a joint located between two longitudinally aligned drywall panels or to a joint located on the inside or outside corner between to drywall panels prior to applying drywall tape thereto.

The applicator includes two side plates pivotally attached together along one edge, via hinges, to the opposite edges of an intermediate member. During use, the intermediate member is positioned centrally over the joint so that the two side plates are positioned against the two adjoining drywall panel surfaces on opposite sides of the joint to be covered with drywall tape. Mounted on the front surface of each side plate are two wheels that support the side plates a small distance above the drywall panel surface and allow the applicator to roll smoothly over the adjoining drywall panel surfaces when applying mud to the joint. Attached to each side plate is a guide member that slides laterally over the side plates front surface to control the width of the mud applied to the drywall panel surface. A guide member locking mechanism is also provided for each guide member to selectively lock the guide plate in a desired position on the side plate. A linking assembly is also provided between the two side plates and the intermediate member that angularly aligns and locks the two side plates at a desired angle on opposite sides of the intermediate member.

The intermediate member is located between the two side plates. Formed centrally on the intermediate member is a transversely aligned, fully extending bore. Located on the inside surface of the intermediate member and adjacent to the bore opening is a mud port connector. During use, the end of a mud delivery tube is selectively connected to the mud port connector to deliver mud from a mud source to the applicator. Disposed inside the bore is a flexible Y-shaped bellows. The distal end of the central leg on the bellows extends from the mud port connector to the front surface of the intermediate member. The two leg members on the bellows extend laterally and terminate inside two elongated port openings formed on the front surfaces of the two side plates. The port openings extend transversely over the front surfaces of the side plates so that a line of mud is delivered under each side plate, which is sufficient in width to cover the perimeter edge's of the adjoining drywall panels.

During use, the side plates are angularly aligned over the adjoining drywall panels so that the pair of wheels on each side panel rolls smooth over the adjoining drywall panel as the tool is pulled longitudinally over the joint. When the two side plates are properly positioned against the two adjoining drywall panels, the bellows bends and flexes so that mud may be evenly delivered through the mud port connector to the two port openings formed on the front surfaces of the two side plates.

DESCRIPTION OF THE PREFERRED EMBODIMENT(S)

Figure 1:
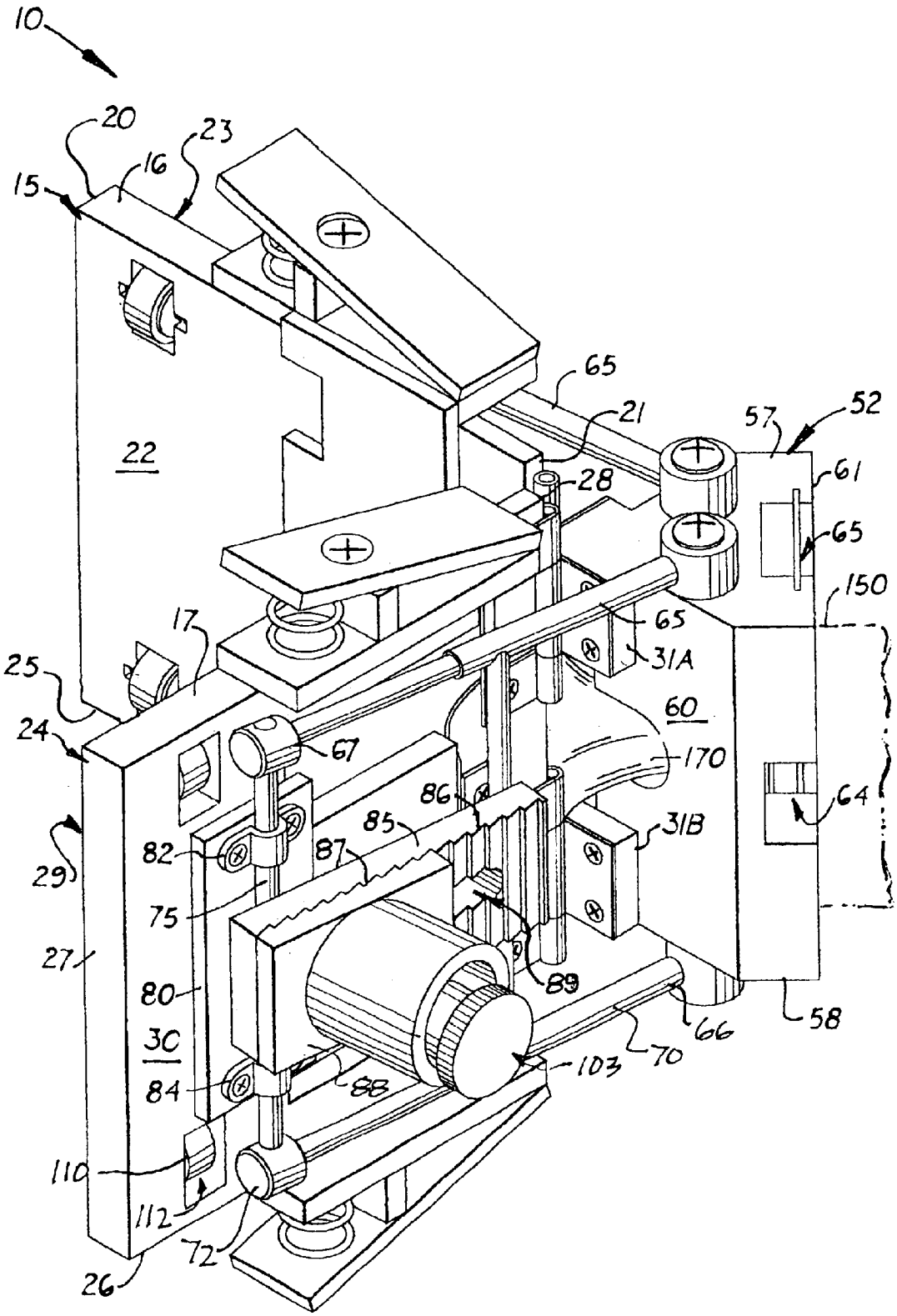
FIG. 1 is a perspective view of the drywall corner mud applicator disclosed herein.
Figure 2:
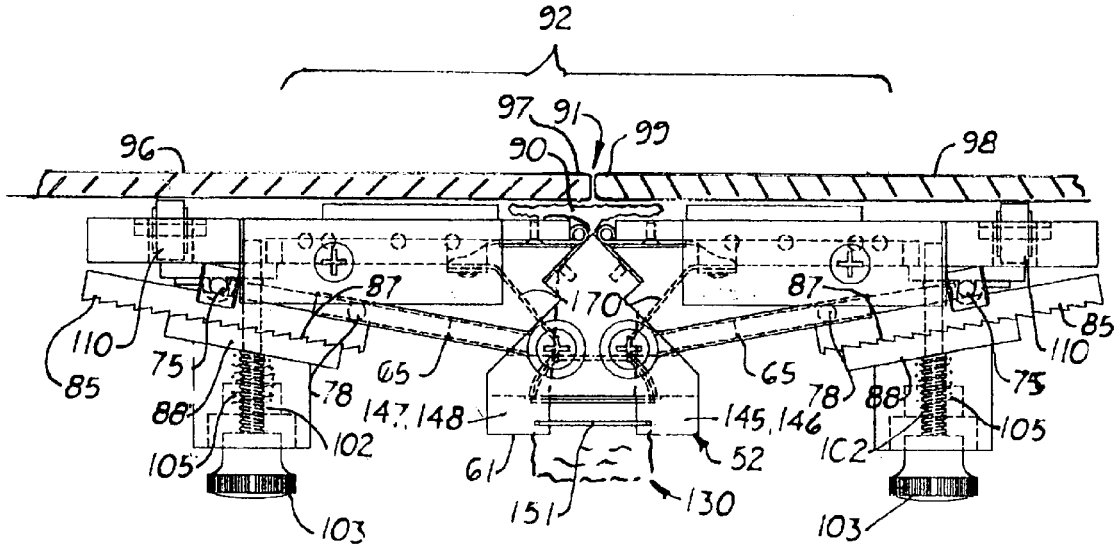
FIG. 2 is a top plan view 6 of the invention.
Figure 7:
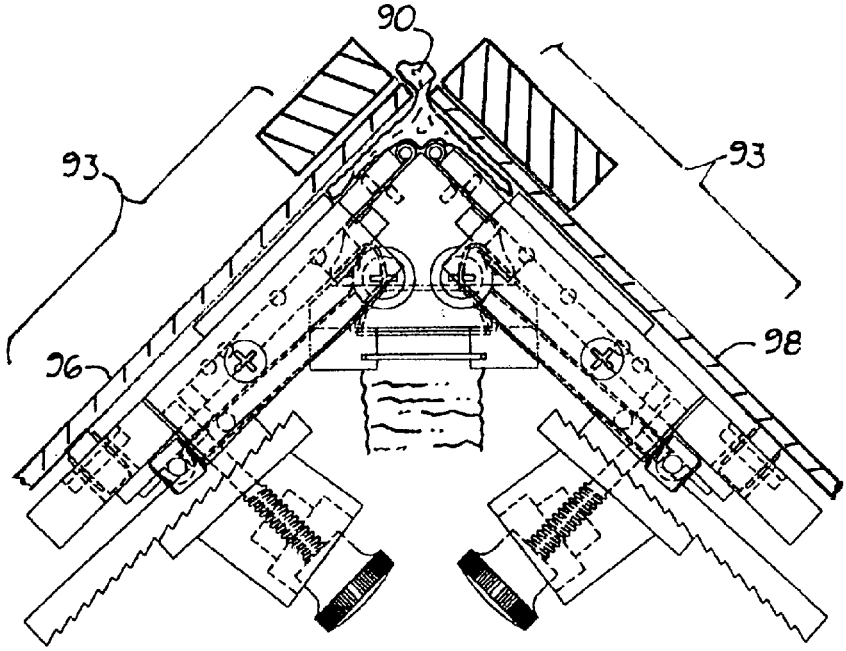
FIG. 7 is a top plan view of the invention shown on an inside corner.
Figure 8:
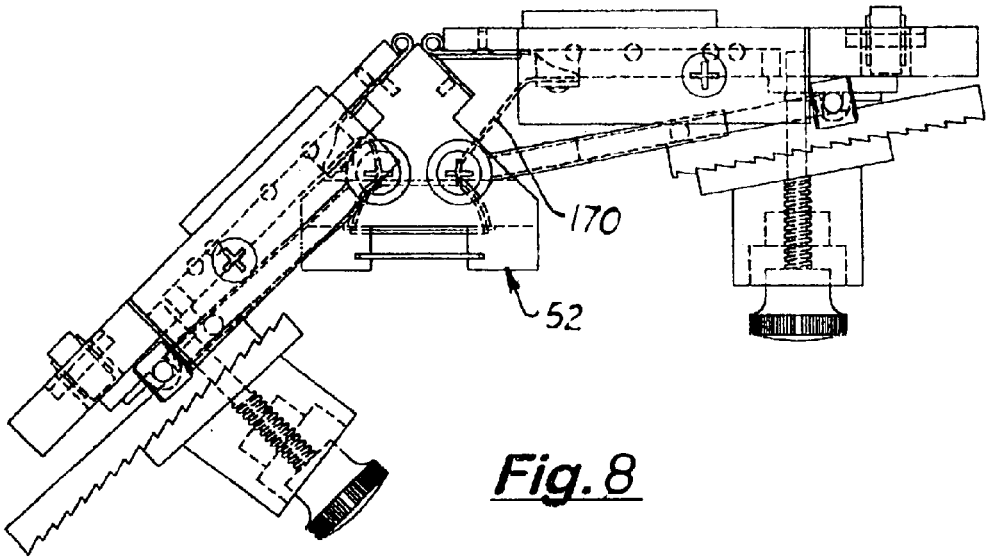
FIG. 8 is a top plan view of the invention showing the invention aligned for used on an inside obtuse corner.
Figure 9:
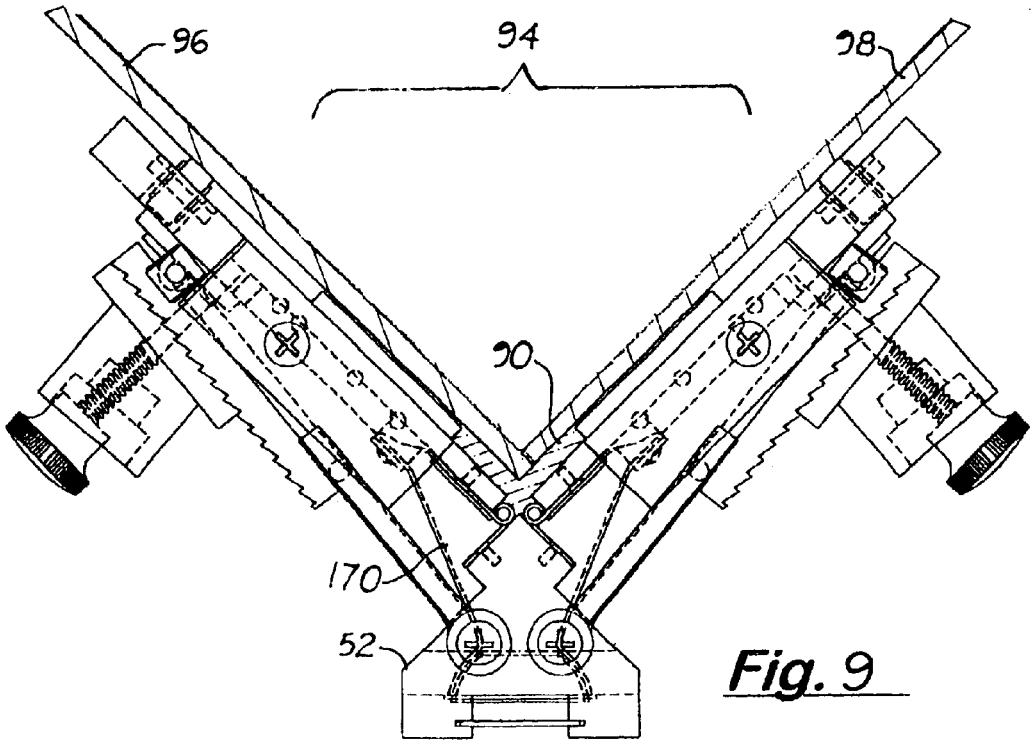
FIG. 9 is a top plan view of the invention showing the invention used on an outside corner.

There is shown in the accompanying FIGS. 1–9 a drywall corner mud applicator, generally referred to as 10, designed to continuously and easily apply an initial layer of mastic material, hereinafter called mud 90, to a joint 91 between two adjacent drywall panels 96, 98 located on a straight wall 92 as shown in FIG. 2, on an inside corner 93 as shown in FIG. 7 or on an outside corner 94 as shown in FIG. 9. The layer of mud 90 is sufficiently thick to fill the joint 91 and sufficiently wide to cover the perimeter edges 97, 99 of the adjoining drywall panels 96, 98, respectively. After the mud 90 is applied to the joint 91, drywall tape 100 may then be applied over the joint 91. The main purpose of the applicator 10 is to quickly and easily apply a thick, uniform layer of mud 90 directly into the joint 91 and over the perimeter edges 97, 99 of the drywall panels 96, 98, respectively.

The applicator 10 includes two side plates 15, 24 pivotally attached to the opposite sides of an intermediate member 52. Each side plate 15, 24 is square or rectangular with parallel top and bottom surfaces 16, 25 and 17, 26 parallel side surfaces 20, 21 and 27, 28 and parallel front and back surfaces 22, 23 and 29, 30, respectively. Attached to each back surface 29, 30 are two hinges 31A, 31B that are evenly spaced apart, and pivotally connect each side plate 15, 24 to the intermediate member 52 discussed in greater detail below.

Figure 4:
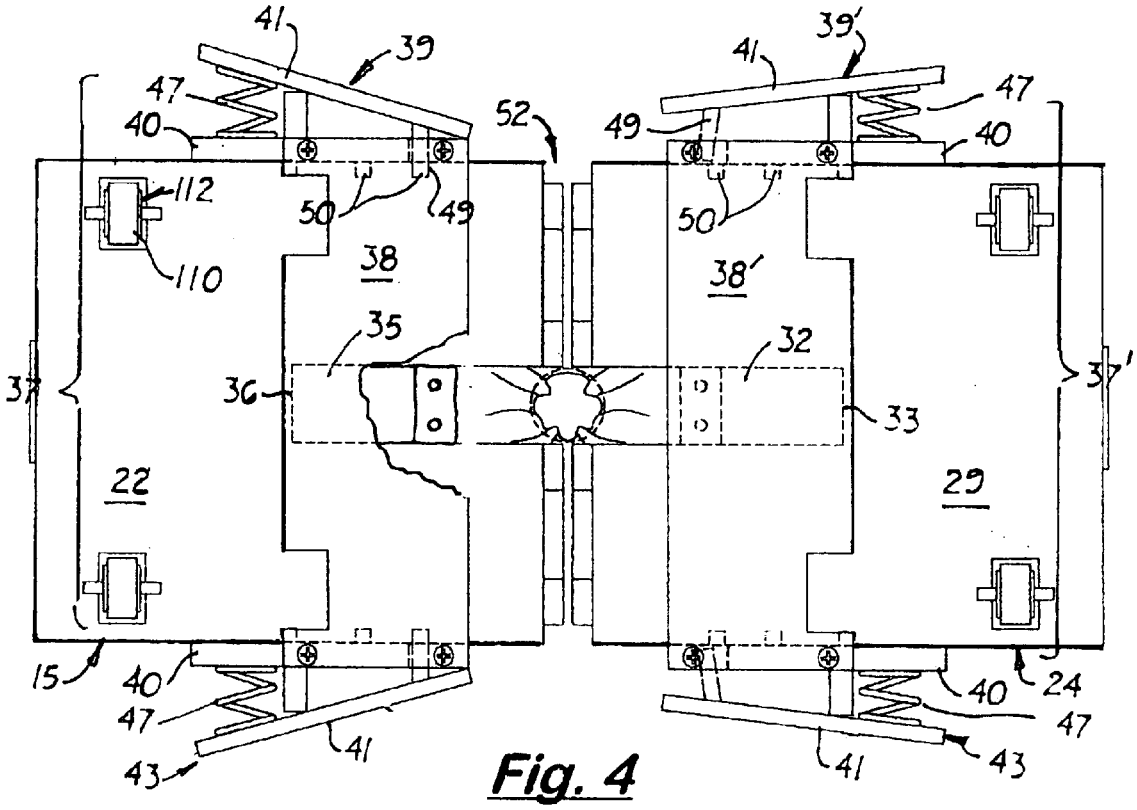
FIG. 4 is a front elevational view of the invention.
Figure 5:
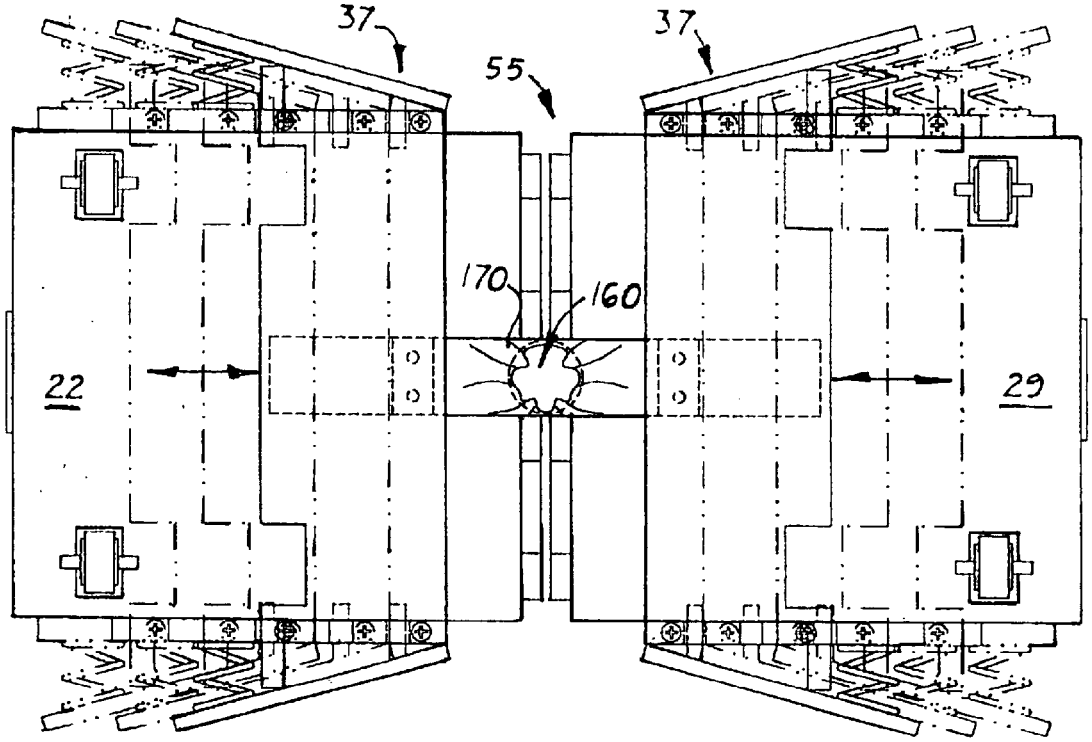
FIG. 5 is a front elevational view of the invention showing the movement of the guide locking clips on each guide plate.
Figure 6:
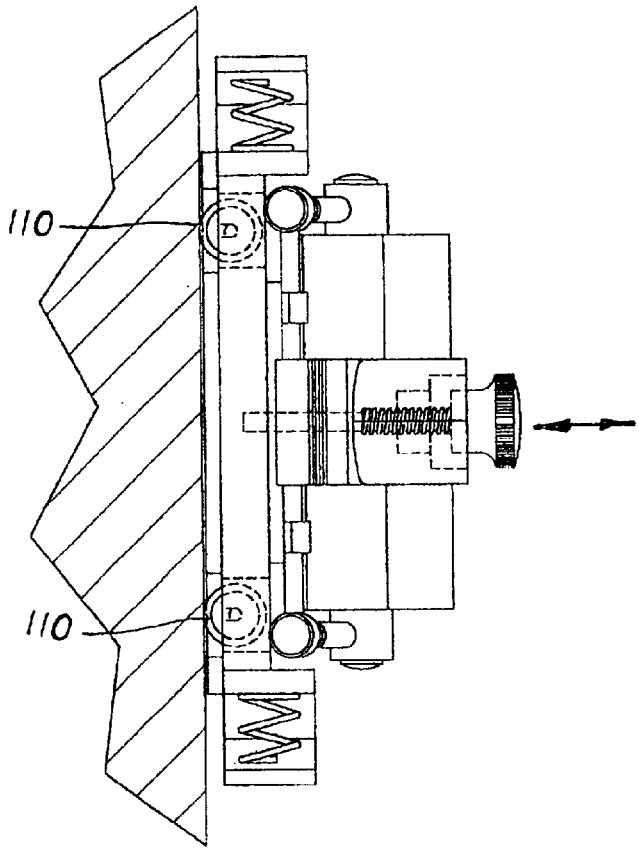
FIG. 6 is a side elevational view of the invention on a drywall surface.

As shown more clearly in FIG. 4, formed on the front surface 22, 29 of each side plate 15, 24 is a transversely aligned port opening 32, 35, respectively. The port opening 32, 35 is centrally aligned on the side plates 15, 24, respectively, and extends rearward to approximately the side panel's center axis. The outer edge 33, 36 of each port opening 32, 35 located near the panel's center axis is closed thereby forming a three-sided longitudinally aligned slot on the front surface 22, 29, respectfully. As discussed further below, during use, mud 90 is delivered from a mud delivery tube and travels through the intermediate member 52 and into the port openings 32, 35.

Mounted on each side plate 15, 24 is an adjustable guide member 37, 37' that slides laterally over the side plate's front surface 22, 29. The two guide members 37, 37' are used to control the width of the mud 90 applied to the outer surface of the adjoining drywall panel. As shown in FIG. 4, each guide member 37, 37' include a rectangular main plate 38, 38' aligned transversely over the front surface 22, 29 of the side plate 15, 24, respectively. Attached to the top and bottom edges of each main plate 38, 38' are two clips 39, 43 and 39', 43', respectively, used to adjustably hold the main plates 38, 38' over the front surfaces 22, 29, respectively. Each clip 39, 39',43 and 43' includes a first plate member 40 and a diagonal plate member 41. Extending perpendicularly from the first plate member is a post upon which the diagonal member pivots. Disposed between the outside ends of the first and diagonal plate members 40, 41 is a spring 47 that acts as a biasing means to hold the opposite, inside end of the diagonal plate member 41 downward. Extending downward from the end of the upper plate members 41, 45 is a pin 49. Holes 50 are formed on the top and bottom surfaces 16, 17 of the side plate 15, 24, respectively, designed to receive the pin 49. During use, the spring 47 forces the outside end of the diagonal member 40 upward so that the pin 49 is forced downward to engage one of the holes 50 on the top or bottom surface 16, 17, 25, or 26 of the side plates 15, 24. When the two clips 39, 43 or 39', 43' on one guide member 37 or 37, respectively, are squeezed together the two pins 49 are retracted from the holes 50 thereby allowing the guide member 37 or 37' to move laterally over the side plate 15 or 24. When the two clips 39, 43 are released the pins 49 automatically engage a new set of holes 50 to lock the guide member 37, 37' in a new position on the side plates 15, 24.

A linking mechanism is disposed between the two side plates 15, 24 and the intermediate member 52 allowing the two side plates 15, 24 to rotate the same amount over the opposite sides of the intermediate member 52 and to lock the side plates in a fixed position. In the preferred embodiment, the linking mechanism includes two pairs of laterally extending, telescopic arms 65, 70, and 65', 70' pivotally connected at their proximal ends 61, 66, respectively, to the top and bottom surfaces 57, 58 of the intermediate member 52. The two extending arms 65, 70 and 65', 70' are aligned substantially parallel and spaced slightly above the back surfaces 23, 30 of the side plate 15, 24. The distal ends 67, 72 and 67', 72' of the two extending arm 65, 70, and 65', 70', respectively, are connected to the opposite ends of a perpendicularly aligned rotating cross-arm 75 that is also attached to the back surface 23, 30 of the side plate 15, 24. Attached at an intermediate location on the two laterally extending arms 65, 70 and 65', 70' is a second fixed cross-arm 78, 78', respectively. Attached to the back surfaces 23, 30 of each side plate 15, 24 is a bracket 80 with two clips 82, 84 that attach the first cross-arm 75 to the back surface 23, 30 of the side plate 15, 24, respectfully. During use, the proximal ends of two extending arms 65, 70 and 65', 70' rotate over the top and bottom surfaces 57, 58, respectfully, of the intermediate member 52. Because each side plate 15, 24 is pivotally attached to the intermediate member 52 and because the extending arms 65, 70 and 65', 70' are equal in length, both side plate's 15, 24 automatically rotate in identical arcs thereby bi-secting the joint 91 which insures that mud 90 is applied centrally over the joint 91.

Figure 3:
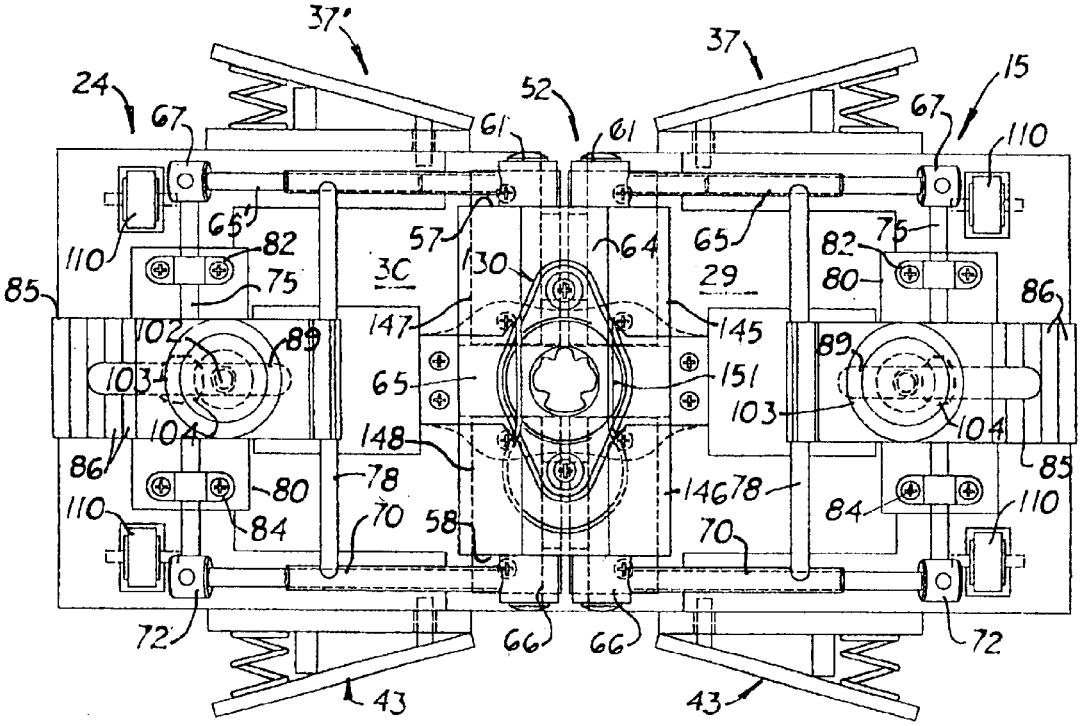
FIG. 3 is a rear elevation view of the invention.

The linking mechanism also includes a locking element that allows the side plates 15, 24 to be locked in position relative to the intermediate member 52. In the preferred embodiment, the locking element includes a transversely aligned lock plate 85 disposed between and attached to the first and second cross-arms 75, 78. As shown in FIG. 3, formed on the back surface of the lock plate 85 is a plurality of teeth 86 that are engaged by teeth 87 formed the front surface on a movable latch plate 88. Formed in the lock plate 85 is a longitudinally aligned opening 89. During assembly, a threaded bolt 102 with a turn knob 103 attached at one end extends through the opening 89, and connects to a threaded connector 104 attached to the cross-arm 75. Disposal around the threaded bolt 102 is a spring 105 that holds the lock plate 85 against the latch plate 88. During use, the turn knob 103 is rotated to release and engage the teeth 86, 87 on the lock plate 85 and latch plate 88, respectively. By adjusting the positions of the latch plates 88 on the lock plates 85, the relative angles of the side plates 15, 24 relative to the intermediate member 52 may be selectively adjusted and then fixed.

Also mounted on the front surface 22, 29 of each side plate 15, 24, respectfully, near the outer edge, are two wheels 110 that allow the applicator 10 to smoothly roll over the adjoining drywall panel's. In the preferred embodiment, two wheel openings 112 are formed on each side plate 15, 24. Extending transversely in each wheel opening 112 is a fixed axle (not shown) that supports the wheel 110 inside the opening 112. The wheel 110 has a sufficient diameter so that the outer surface of the wheel 110 extends outward from the wheel opening 112 to engage the drywall panel surface and hold the front surfaces of the side panels 15, 24 approximately 3/16 inches above the drywall surfaces as the applicator 10 is pulled longitudinally over a joint 91.

As mentioned above, the intermediate member 52 is located between the two, side plates 15, 24. In the preferred embodiment, the intermediate member 52 is an elongated, triangular-shaped structure with two flat top and bottom surfaces 57, 58, two lateral surfaces 59, 60 and a flat back surface 61. Attached to the two flat lateral surfaces 59, 60 near the upper and lower edges of the intermediate member 52 are two pairs of hinges 31A, 31B that pivotally connect the two side plates 15, 24 to the intermediate member 52.

As shown in FIGS. 2 and 3, formed on the back surface 61 of the intermediate member 52 is mud port connector 130. In the preferred embodiment, the mud port connector 130 includes a vertically aligned slot 64 and a horizontally aligned slot 65. Formed around the slots 64, 65 are four raised surfaces 137, 141, 142, 143 with a groove 145, 146,

147, 148, respectively, that receives two legs 150 formed on a flexible U-shaped clip 151. During assembly, the nozzle on the mud delivery tube 150 is engaged by the clip 151 to securely hold the tube 150 on the intermediate member 52.

Formed on the intermediate member 52 is a fore and aft aligned bore 160 that extends from the back surface 56 of the intermediate member 52 to the two front lateral surfaces 59, 60. Disposed inside the bore 160 is a flexible Y-shaped bellows 170 that bends and flexes when the side plates 15, 24 are aligned at different angles so that mud is centrally delivered to each port opening 32, 35, respectfully formed thereon.

During use, the applicator 10 is aligned over a desired joint 91. The turn knobs 103, 103' are then loosened so that the two latch plates 88, 88' may be adjusted on the two lock plates 85, 85' to allow the side plates 15, 24 to be properly positional over the two adjoining drywall surfaces. The turn knobs 103, 103' are then tightened to lock the side plates 15, 24 in position. The guide members 37, 37 are then adjusted on each side plate 15, 24, respectfully, so that the width of the mud layer is slightly larger than the width of the drywall tape to be used on the joint. The nozzle of the mud delivery tube 150 is then attached to the clip 151. The applicator 10 is then positioned over the joint 91 so that the center axis of the intermediate member 52 is aligned over the longitudinal axis of the joint 91. The mud source is then activated to deliver mud 90 to the intermediate member 52. The applicator 10 is then moved smoothly and continuously over the joint 91 to deliver mud 90 to the joint 91.

In compliance with the statute, the invention described herein has been described in language more or less specific as to structural features. It should be understood, however, that the invention is not limited to the specific features shown since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I Claim:

1. A drywall mud applicator, comprising:

a. two side plates each including front and rear surfaces with laterally extending port openings formed on said front surface;

b. an intermediate member located between said two side plates, said intermediate member including a central bore;

c. a Y-shaped, flexible bellows located inside said central bore on said intermediate member that extends laterally into said port openings formed on said side plates, said bellows being able to bend and flex when said side plates are aligned at different angles relative to said intermediate member; and, d. at least one hinge located between intermediate member and each said side plate to pivotally attach each said side plate to said intermediate member.

2. The drywall mud applicator, as recited in claim 1, further including a guide member located over said front surface of each said side plate.

3. The drywall mud applicator, as recited in claim 2, wherein each said guide member further includes a guide plate locking means for selectively locking said guide plate in a desired position on said side plate.

4. The drywall mud applicator as recited in claim 3, further including a linking assembly disposed between said side plate and said intermediate member to couple the angular movement of said side plates so that said immediate member is maintained in a centrally aligned position over a joint located between two adjacent drywall panels.

5. The drywall mud applicator, as recited in claim 4, wherein said linking assembly further includes means to selectively lock said side plate in position with respect to said intermediate member.

6. The drywall mud applicator as recited in claim 2, further including a linking assembly disposed between said side plates and said intermediate member to couple the angular movement of the said side plates.

7. The drywall mud applicator, as recited in claim 6, wherein said linking assembly further includes means to selectively lock said side plates in a desired angular position with respect to said intermediate member.

8. The drywall mud applicator, as recited in claim 2, further including a port connector attached to said intermediate member that selectively connects to a mud delivery tube.

9. The drywall mud applicator, as recited in claim 1, further including at least one wheel attached to each said side plate to allow said applicator to roll across adjacent drywall panels.

10. The drywall mud applicator, as recited in claim 2, further including at least one wheel attached to each said side plate to allow said applicator to roll across two adjacent drywall panels.

11. The drywall mud applicator, as recited in claim 9, further including a port connector attached to said intermediate member that selectively connects to a mud delivery tube.

12. The drywall mud applicator, as recited in claim 1 further including at least one wheel attached to each said side plate to allow said applicator to roll across two adjacent drywall panels.

13. The drywall mud applicator, as recited in claim 1, further including a linking assembly disposed between said side plates and said intermediate member to couple the angular movement of said side plates.

14. The drywall mud applicator, as recited in claim 13, wherein said linking assembly further includes means to selectively lock said side plates in a desired angular position with respect to said intermediate member.

15. The drywall mud applicator, as recited in claim 1, further including a port connector attached to said intermediate member that selectively connects to a mud delivery tube.

16. A drywall mud applicator, comprising:

a. two side plates each including front and rear surfaces with laterally extending port openings formed on said front surface;

b. an intermediate member located between said two side plates, said intermediate member including a central bore with a port connector located on the rear surface of said intermediate member that enables a mud source tube to connect to said intermediate member;

c. a Y-shaped, flexible bellows located inside said central bore that extends laterally to said port openings formed on said side plates, said bellows being able to bend and flex when said side plates are aligned at different angles relative to said intermediate member;

d. at least one hinge located between intermediate member and each said side plate; and, e. at least one wheel attached to each said side plate to allow said applicator to roll over adjacent drywall panels.

17. The drywall mud applicator, as recited in claim 16, further including a guide member located on said front surface of said side plate.

18. The drywall mud applicator, as recited in claim 17, where each said guide member further includes a guide plate locking means.

19. The drywall mud applicator, as recited in claim 18, further including a linking assembly disposal between each said side plates and said intermediate member.

20. A method of applying drywall mud to a drywall joint, comprising the following steps;

a. selecting a drywall mud application that includes two side plates each including front and rear surfaces with laterally extending port openings formed on said front surface, an intermediate member located between said two side plates, said intermediate member including a central bore with a port connector located on the rear surface of said intermediate member that enables a mud source tube to connect to said intermediate member, a Y-shaped, flexible bellows located inside said central bore that extends laterally to said port openings formed on said front surface of said side plates, said bellows being able to bend and flex when said side plates are aligned at different angles relative to said intermediate member, at least one hinge located between intermediate member and each said side plate, at least one wheel assembly formed on the front surface of each said side plate;

b. attaching a mud delivery tube to said port connector on said intermediate member;

c. positioning said side plates centrally over a joint so that said wheel assembly on said side plates are positioned over the perimeter edges of two adjoining drywall panels;

d. activating a mud source to deliver mud to said intermediate member;

e. rolling said intermediate member longitudinally over a joint located between adjacent drywall panels to deliver mud thereto;

f. deactivating a mud source when mud has been deposited over said joint; and, g. applying drywall tape to said layer of mud deposited over said joint.

* * * * *